US010243282B1

(12) United States Patent
Lin

(10) Patent No.: US 10,243,282 B1
(45) Date of Patent: Mar. 26, 2019

(54) LINKING ROD CLAMPING MECHANISM FOR CONNECTING COAXIAL CONNECTOR WITH PRINTED CIRCUIT BOARD

(71) Applicant: HUANG LIANG TECHNOLOGIES CO., LTD., Kaohsiung (TW)

(72) Inventor: Kuo-Tung Lin, Kaohsiung (TW)

(73) Assignee: Huang Liang Technologies Co., Ltd., Kaohsiung (TW)

( * ) Notice: Subject to any disclaimer, the term of this patent is extended or adjusted under 35 U.S.C. 154(b) by 0 days.

(21) Appl. No.: 15/975,034

(22) Filed: May 9, 2018

(51) Int. Cl.
*H01R 9/05* (2006.01)
*H01R 4/52* (2006.01)

(52) U.S. Cl.
CPC ..... *H01R 9/05* (2013.01); *H01R 4/52* (2013.01)

(58) Field of Classification Search
CPC .... H01R 24/50; H01R 9/0515; H01R 4/4863; H01R 4/489
USPC ..... 439/63, 581, 729
See application file for complete search history.

(56) References Cited

U.S. PATENT DOCUMENTS 2,599,006 A * 6/1952 Melchior ..... H01R 4/4872 439/729
3,382,478 A * 5/1968 Satterthwait ..... H01R 4/52 439/712
5,823,832 A * 10/1998 Das ..... A61B 5/0416 439/817
7,165,974 B2 * 1/2007 Kooiman ..... H01R 24/52 439/63

* cited by examiner

*Primary Examiner* — Hien Vu
(74) *Attorney, Agent, or Firm* — Rosenberg, Klein & Lee

(57) ABSTRACT

A linking rod clamping mechanism for connecting a coaxial connector with a printed circuit board includes a fine adjustment assembly that includes a cam and a screw to link with each other, an elastic assembly, and a connecting rod assembly consisting of at least two rectangular bodies. The positioning is achieved in a push manner by pushing the rotating handle down or lifting the rotating handle up, providing a stable structure, reliable operation, simple and quick operation. The linking rod clamping mechanism not only exerts an even force but also can determine the yield and decrease the adjustment time greatly. Furthermore, after the fine adjustment assembly is adjusted, the printed circuit board is clamped for performing a test. The same printed circuit boards in thickness can be quickly replaced and reused, thereby improving the yield and increasing the error tolerance.

6 Claims, 8 Drawing Sheets

(A-A)

(A-A)

(A-A)

LINKING ROD CLAMPING MECHANISM FOR CONNECTING COAXIAL CONNECTOR WITH PRINTED CIRCUIT BOARD

FIELD OF THE INVENTION

The present invention relates to a clamping mechanism, and more particularly to a linking rod clamping mechanism for connecting a coaxial connector with and a printed circuit board.

BACKGROUND OF THE INVENTION

In general, a printed circuit board and a clamping plate joint are combined by welding. Therefore, welding personnel's welding technology and experience are very important. After welding, the printed circuit board and the clamping plate joint cannot be separated from each other and can no longer be used afterwards.

Therefore, the industry developed a clamping plate joint as shown in FIGS. 1 and 2, that is, a clamping plate fixing mechanism 100' for connecting a coaxial connector with a printed circuit board. The clamping plate fixing mechanism 100' includes an upper clamping plate 1' and a lower clamping plate 2' to clamp a printed circuit board 300'. The upper clamping plate 1' and the lower clamping plate 2' are assembled and disassembled through a plurality of screws 3'. A coaxial connector 200' is fixed at a predetermined position of the upper clamping plate 1'. (See the position P' in FIG. 1).

Although it can solve the problem that the combination is achieved by welding, but they are manually connected by using screws 3', which is time-consuming. When they are fixed, the applied force may be uneven. As a result, it is impossible to determine the yield, and it may take a lot of time for adjustment. This is very inconvenient.

Accordingly, the inventor of the present invention has devoted himself based on his many years of practical experiences to solve these problems.

SUMMARY OF THE INVENTION

In view of the aforesaid problem, the primary object of the present invention is to provide a linking rod clamping mechanism for connecting a coaxial connector with a printed circuit board. The clamping mechanism comprises a fine adjustment assembly that includes a cam and a screw to link with each other, an elastic assembly, and a connecting rod assembly consisting of at least two rectangular bodies. The positioning is achieved in a push manner by pushing the rotating handle down or lifting the rotating handle, providing a stable structure, reliable operation, simple and quick operation, and saving working hours. The printed circuit board can be attached to the first body and the second body closely, and can be attached to the vertical surface of the horizontal plate. In addition, compared with the prior art that is secured and detached by means of screws, the present invention not only exerts an even force but also can determine the yield and decrease the adjustment time greatly. Furthermore, the present invention does not require a welding procedure, and can be used for clamping different printed circuit boards. After the fine adjustment assembly is adjusted, the printed circuit board is clamped for performing a test. The same printed circuit boards in thickness can be quickly replaced and reused, thereby improving the yield and increasing the error tolerance.

In addition, after the printed circuit board is clamped by the first body and the second body, if the alignment is inaccurate or the printed circuit board needs to be adjusted before the test or during the test, the cam lever can be rotated by the rotating handle of the fine adjustment assembly, and the cam of the cam lever abuts against the second screw. The elasticity of the elastic assembly enables the first body and the second body to have a slight space therebetween for the printed circuit board to be finely adjusted. There is no need to re-position the entire linking rod clamping mechanism, which facilitates operation and saves working hours, thereby reducing the probability of a test error.

In order to achieve the aforesaid object, a linking rod clamping mechanism for connecting a coaxial connector with a printed circuit board is provided. The linking rod clamping mechanism comprises a first body, an elastic assembly, a linking rod assembly, a groove, and a passage. The elastic assembly passes through the first body from top to bottom. A portion of the linking rod assembly is connected to a bottom of the elastic assembly and is movably connected to the first body. The groove is disposed on a surface of the first body, facing the linking rod assembly. The passage is disposed at a portion of the first body away from the linking rod assembly and communicates with the groove.

In some embodiments, the first body has a plate body, a left vertical plate, a right vertical plate, and a horizontal plate. The left vertical plate and the right vertical plate are located at left and right sides of the plate body and extend downward from a lower surface of the plate body, respectively. Left and right sides of the horizontal plate are connected to the left vertical plate and the right vertical plate, respectively. An upper surface of the horizontal plate is connected to the lower surface of the plate body. The passage is disposed on the lower surface of the plate body.

In some embodiments, the first body has at least two stepped holes that are spaced and vertically pass through the plate body and the horizontal plate.

In some embodiments, the elastic assembly has at least two first screws and at least two elastic elements. The first screws pass through the corresponding stepped holes, respectively. Respective bottoms of the first screws are connected to the linking rod assembly. The elastic elements are sleeved on the corresponding first screws, respectively. Two ends of each elastic element abut against a corresponding one of the stepped holes and a head of a corresponding one of the first screws, respectively.

In some embodiments, the linking rod assembly includes a second body, a third body, at least two left linking rods, at least two right linking rods, and a plurality of first positioning pins. The second body is disposed close to the lower surface having the groove of the first body. The second body is formed with a first left accommodating slot and a first right accommodating slot close to left and right ends thereof. The third body is disposed under the second body. The third body has a second left accommodating slot and a second right accommodating slot. The second left accommodating slot corresponds in position to the first left accommodating slot. The second right accommodating slot corresponds in position to the first right accommodating slot. The at least two left linking rods are laterally spaced apart from each other. A top of each left linking rod is pivotally connected to the first left accommodating slot through a corresponding one of the positioning pins. A bottom of each left linking rod is pivotally connected to the second left accommodating slot through a corresponding one of the positioning pins. The at least two right linking rods are laterally spaced apart from each other. A top of each right linking rod is pivotally connected to the first right accommodating slot through a corresponding one of the positioning pins. A bottom of each right linking rod is pivotally connected to the second right accommodating slot through a corresponding one of the positioning pins. The tops of the left linking rods and the right linking rods are aligned with each other on a same horizontal line and face up in the direction of the horizontal plate. The bottoms of the left linking rods and the right linking rods are aligned with each other on another same horizontal line and face in a direction away from the horizontal plate. The left linking rods and the right linking rods are arranged obliquely relative to the second body and the third body.

In some embodiments, the third body has a first block portion, a second block portion and a third block portion sequentially connected to each other. The first block portion corresponds in position to the second body. The first block portion is provided with the second left accommodating slot and the second right accommodating slot. The second block portion corresponds in position to the elastic assembly. A screw thread formed at the bottom of each first screw is screwed to the second block portion. The third block portion is provided with at least two second positioning pins and a second screw. The second positioning pins are laterally spaced apart from each other and pass through the third block portion, the horizontal plate and the plate body. The second screw is inserted upward to pass through the third block portion and is screwed to the third block portion in an adjustable manner.

In some embodiments, the linking rod clamping mechanism further comprises a fine adjustment assembly. The fine adjustment assembly includes a cam lever, a flange, and a rotating handle. The cam lever passes through the left vertical plate and the right vertical plate. The cam lever is provided with a cam. The cam is located above the second screw and is in contact with the second screw. The flange is connected to one end of the cam lever and is exposed outside the first body. The rotating handle is connected to one side of the flange away from the cam lever.

DETAILED DESCRIPTION OF THE PREFERRED EMBODIMENTS

With regard to the technical means by which the present invention achieves the above-mentioned objects, embodiments of the present invention will now be described, by way of example only, with reference to the accompanying drawings.

Figure 1:
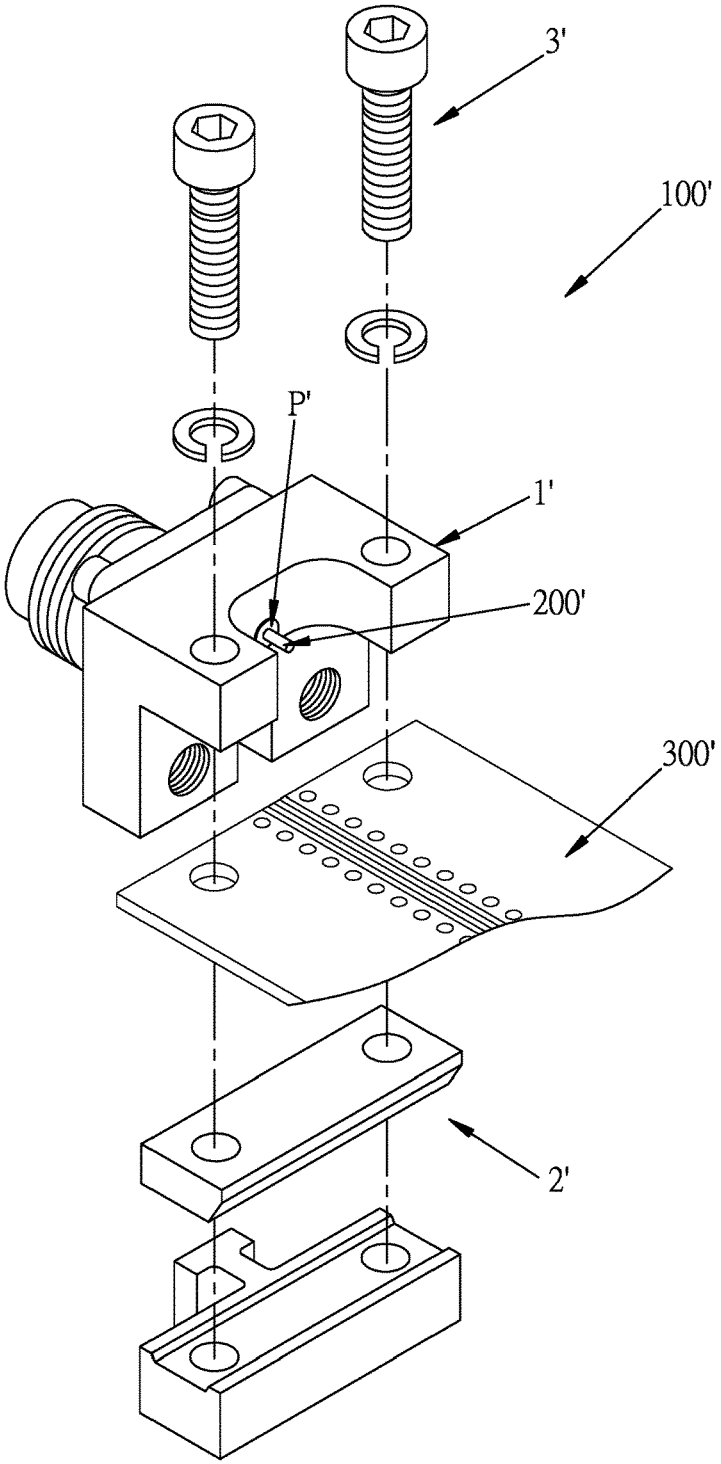
FIG. 1 (Prior art)
FIG. 1 is an exploded view of a conventional clamping plate fixing mechanism for connecting a coaxial connector with a printed circuit board.
Figure 2:
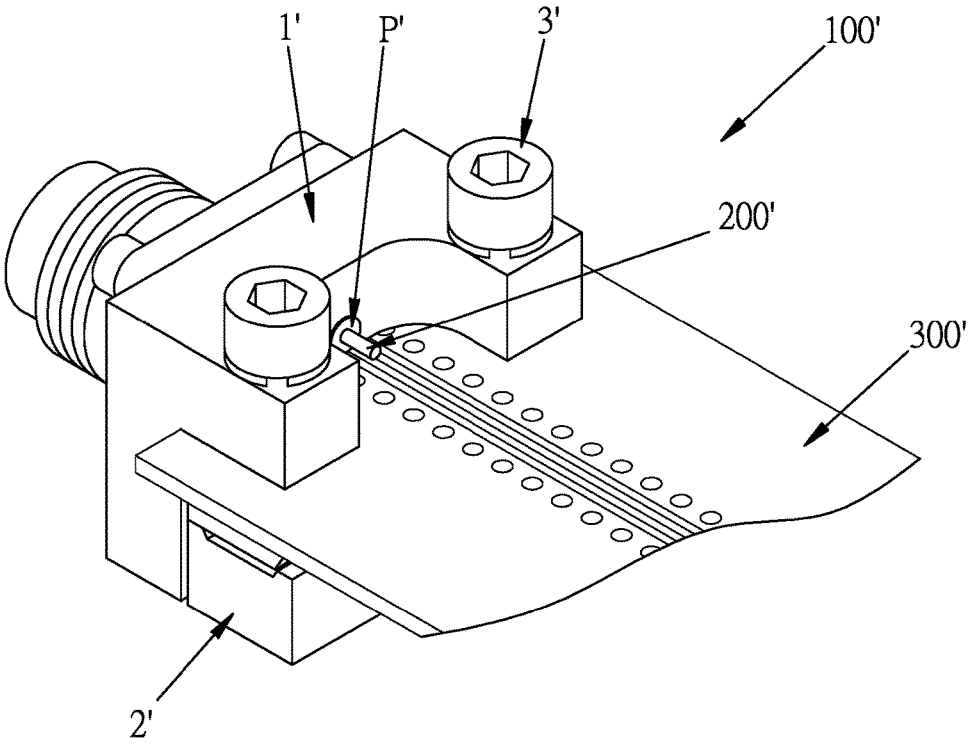
FIG. 2 (Prior art)
FIG. 2 is a perspective view of FIG. 1.
Figure 3:
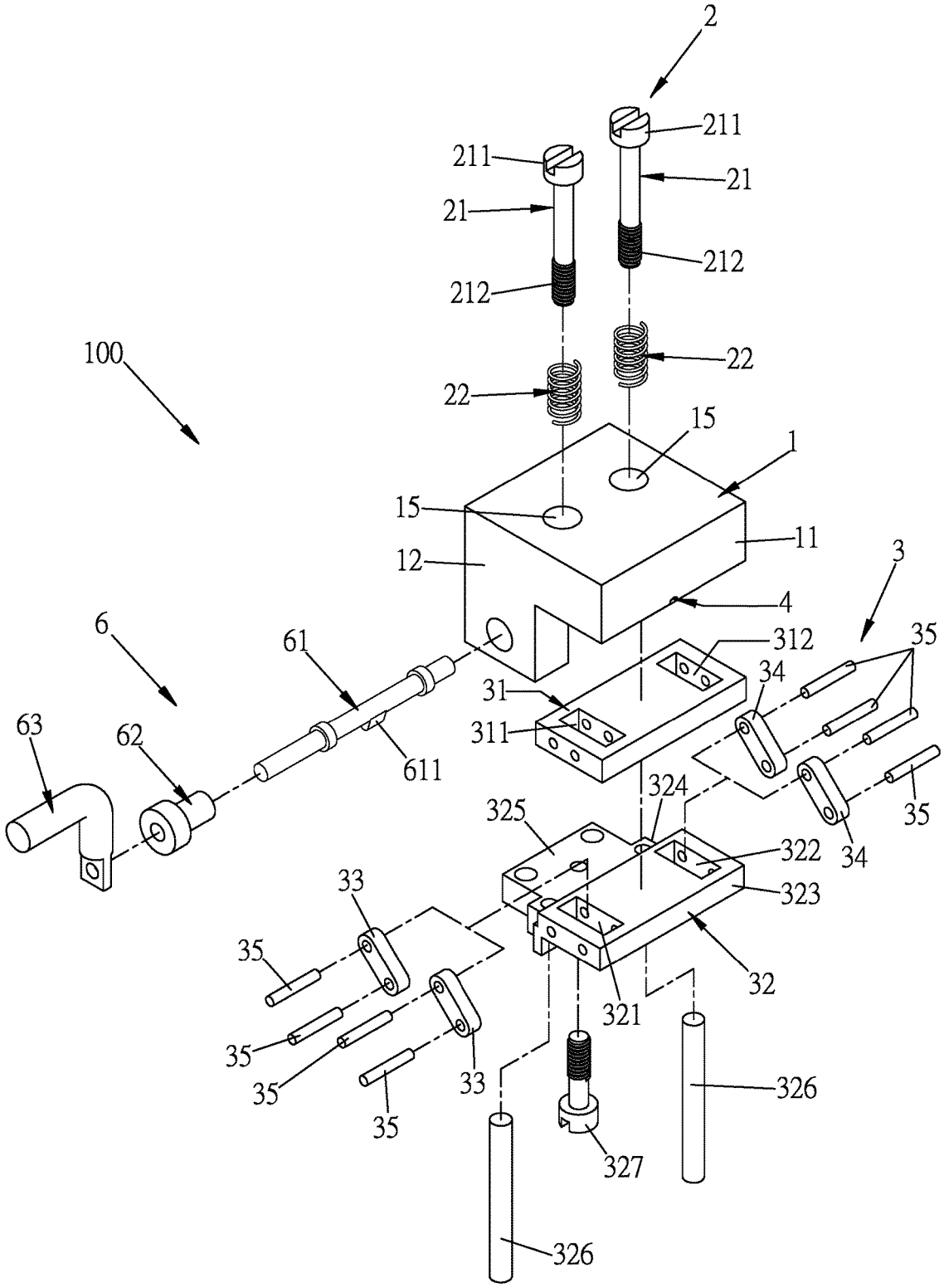
FIG. 3 is a top exploded view of a linking rod clamping mechanism for connecting a coaxial connector with a printed circuit board in accordance with the present invention.
Figure 4:
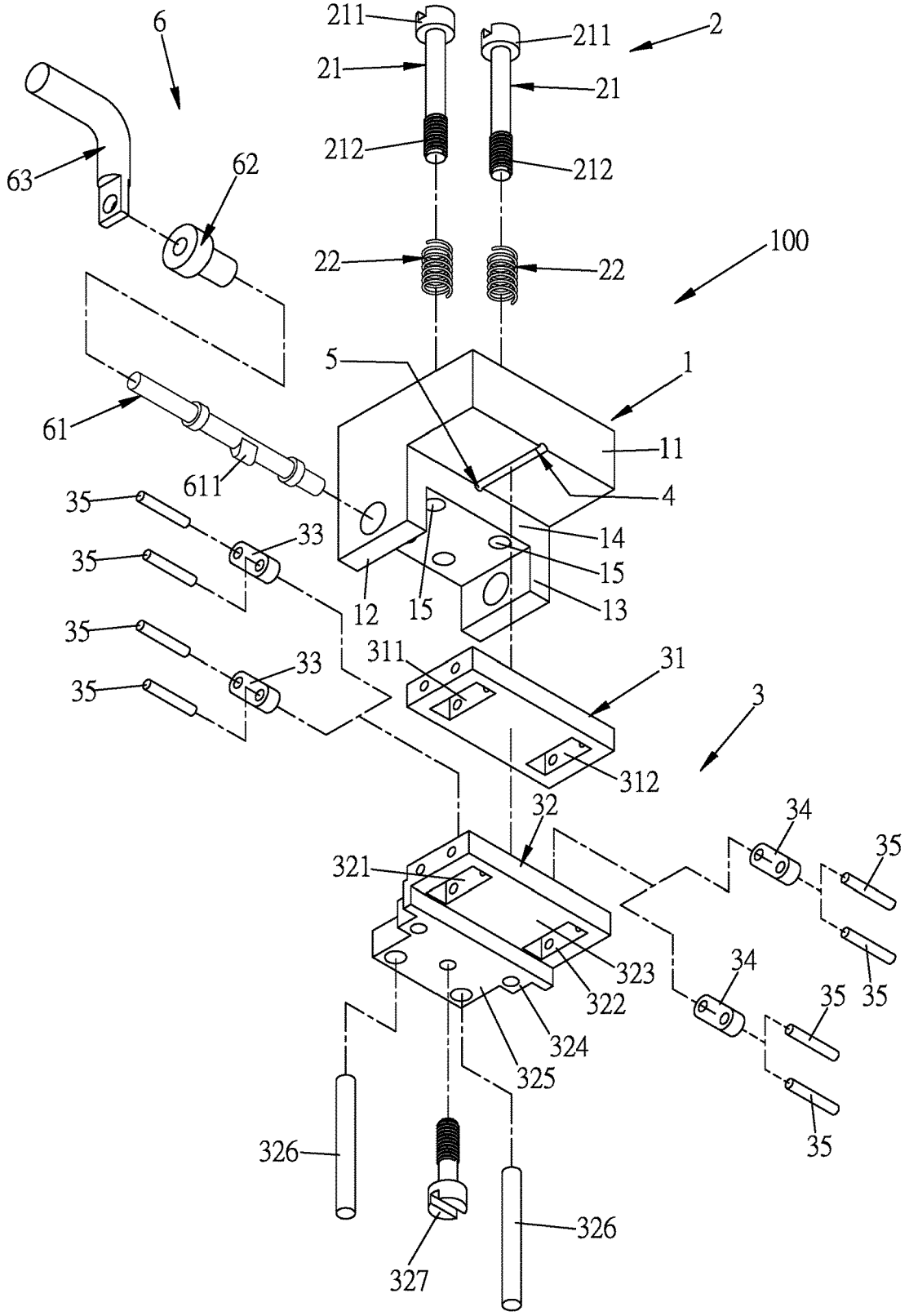
FIG. 4 is a bottom exploded view of the linking rod clamping mechanism in accordance with the present invention.
Figure 5:
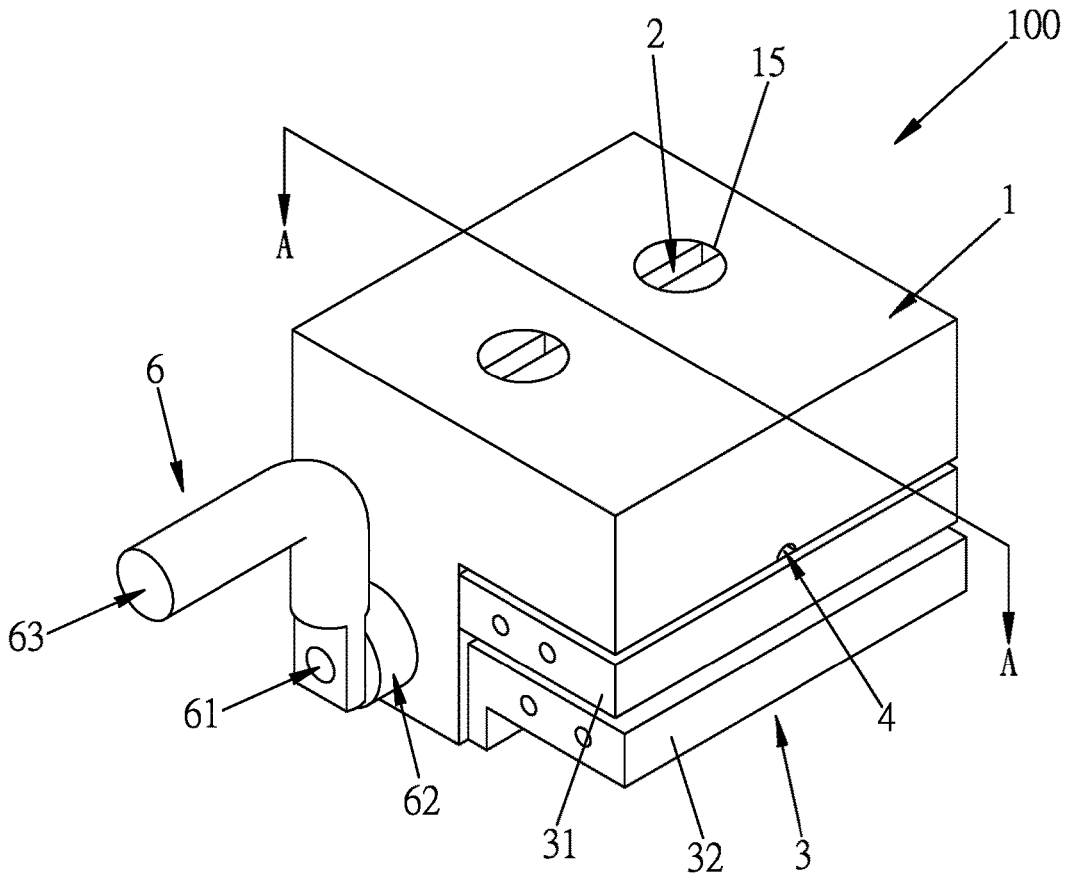
FIG. 5 is a perspective view of the linking rod clamping mechanism in accordance with the present invention.
Figure 6:
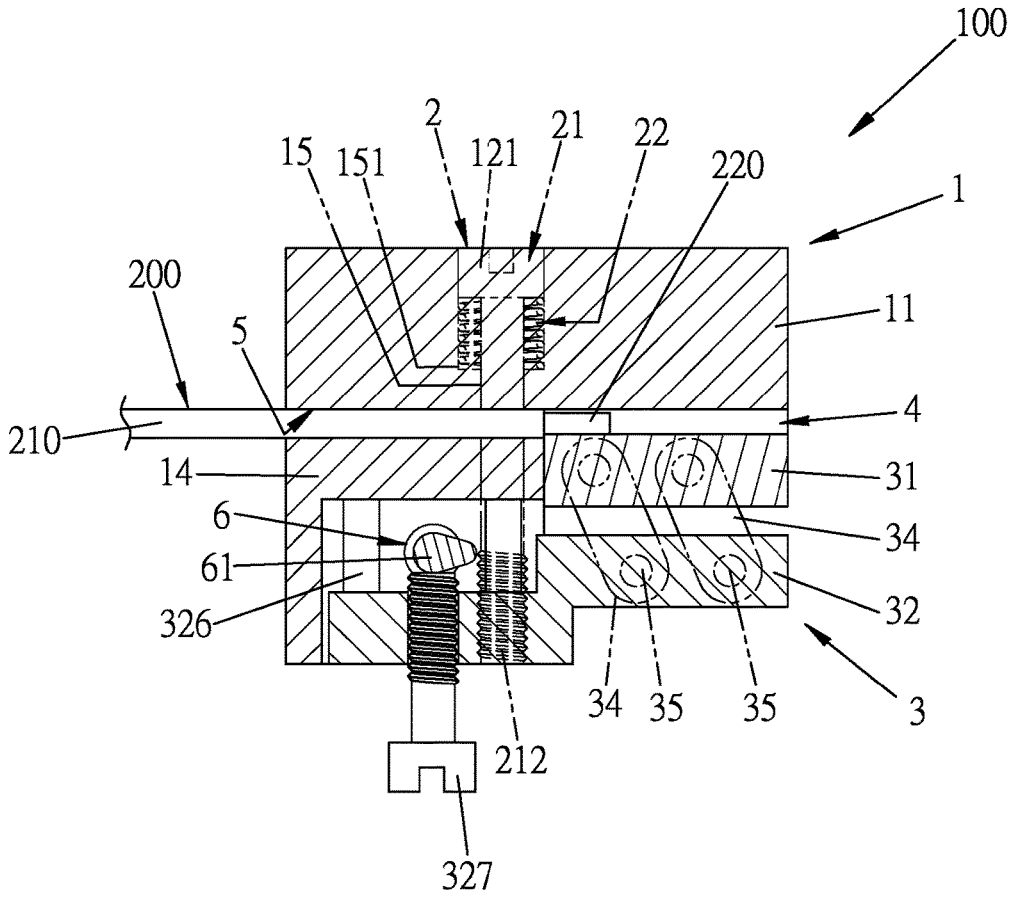
FIG. 6 is a sectional view taken along the line A-A of FIG. 5.
Figure 7:
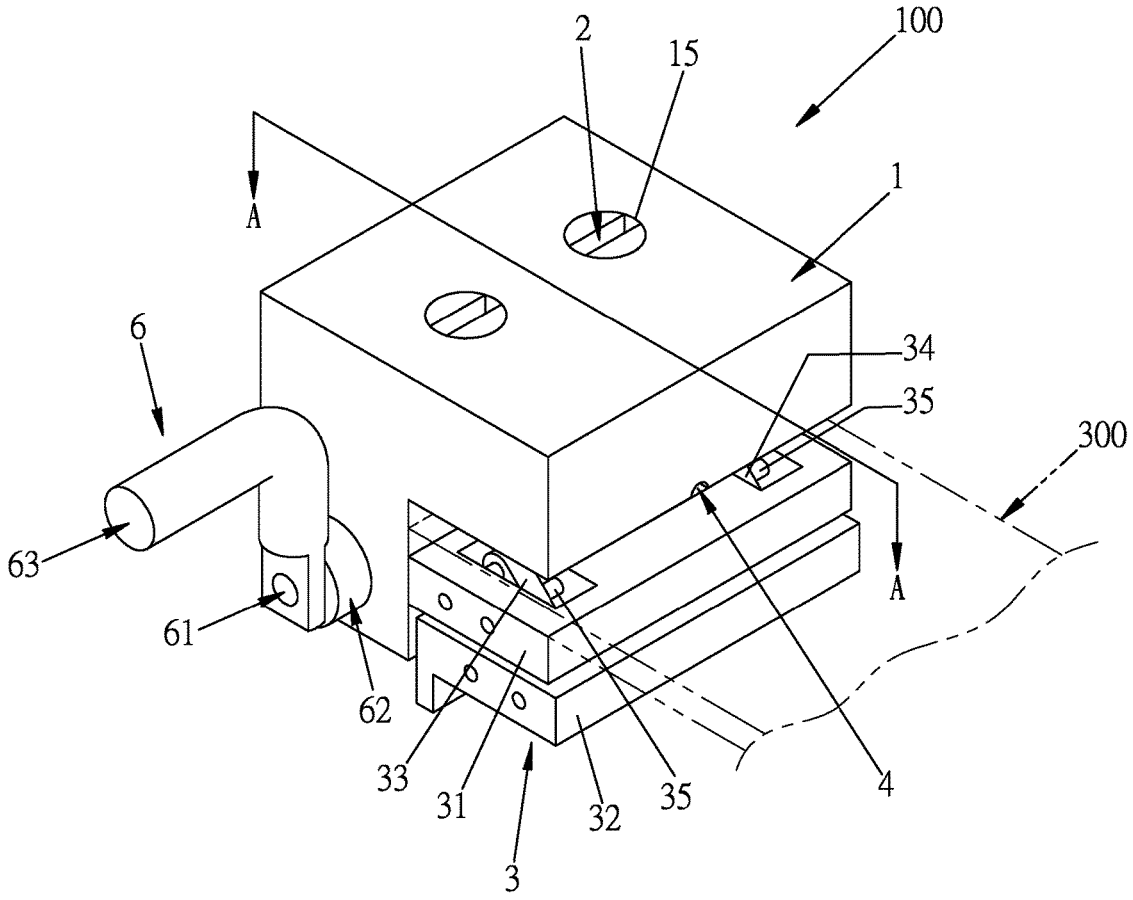
FIG. 7 is a perspective view of the linking rod clamping mechanism in accordance with the present invention, showing that the cam lever is rotated for a fine adjustment.
Figure 8:
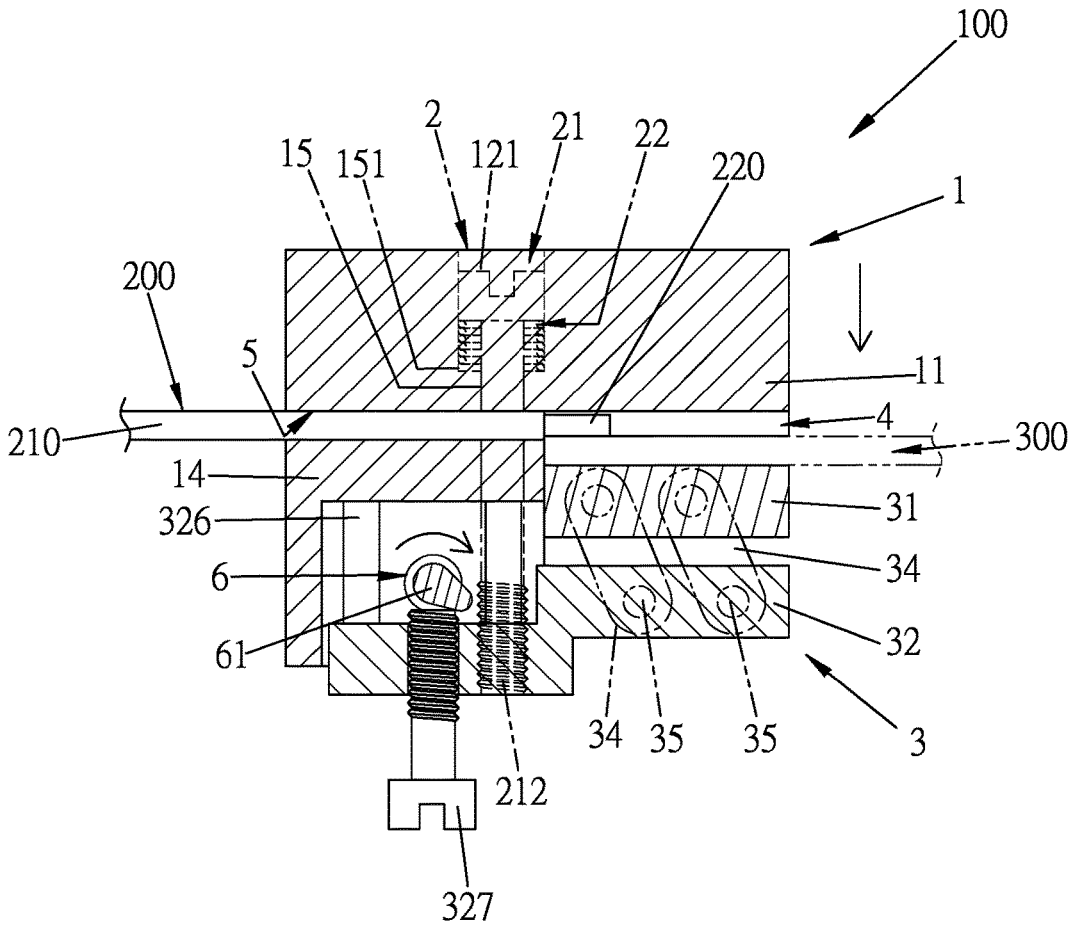
FIG. 8 is a sectional view taken along the line A-A of FIG. 7, showing that the coaxial connector and the printed circuit board are inserted in the linking rod clamping mechanism in accordance with the present invention.

Referring to FIG. 3 to FIG. 8, a linking rod clamping mechanism 100 for connecting a coaxial connector with a printed circuit board in accordance with the present invention comprises a first body 1, an elastic assembly 2, a linking rod assembly 3, a groove 4, and a passage 5. Wherein, the groove 4 is disposed on a surface of the first body 1 facing the linking rod assembly 3. The passage 5 is disposed at a portion of the first body 1 away from the linking rod assembly 3 and communicates with the groove 4.

The first body 1 has a plate body 11, a left vertical plate 12, a right vertical plate 13, and a horizontal plate 14. The left vertical plate 12 and the right vertical plate 13 are located at left and right sides of the plate body 11 and extend downward from a lower surface of the plate body 11, respectively. Left and right sides of the horizontal plate 14 are connected to the tops of the left vertical plate 12 and the right vertical plate 13, respectively. An upper surface of the horizontal plate 14 is connected to the lower surface of the plate body 11. The passage 5 is disposed on the lower surface of the plate body 11.

In addition, the first body 1 has at least two stepped holes 15 that are spaced and vertically pass through the plate body 11 and the horizontal plate 14.

The elastic assembly 2 passes through the first body 1 from top to bottom. The elastic assembly 2 has at least two first screws 21 and at least two elastic elements 22 (such as compression springs, etc.). The first screws 21 pass through the corresponding stepped holes 15, respectively. The bottoms of the first screws 21 are connected to the linking rod assembly 3. The elastic elements 22 are sleeved on the corresponding first screws 21, respectively. Two ends of each elastic element 22 abut against a corresponding one of the stepped holes 15 and a head 211 of a corresponding one of the first screws 21, respectively. Wherein, each stepped hole 15 has a shoulder 151 for the corresponding elastic element 22 to abut.

A portion of the linking rod assembly 3 is connected to the bottom of the elastic assembly 2 and is movably connected to the first body 1. The linking rod assembly 3 includes a second body 31, a third body 32, at least two left linking rods 33, at least two right linking rods 34, and a plurality of first positioning pins 35. The second body 31 has a substantially rectangular shape (such as a parallelogram, etc.) and is disposed close to the lower surface having the groove 4 of the first body 1. The second body 31 is formed with a first left accommodating slot 311 and a first right accommodating slot 312 close to left and right ends thereof. The third body 32 has a substantially rectangular shape (such as a parallelogram, etc.) and is disposed under the second body 31. The third body 32 has a second left accommodating slot 321 and a second right accommodating slot 322. The second left accommodating slot 321 corresponds in position to the first left accommodating slot 311. The second right accommodating slot 322 corresponds in position to the first right accommodating slot 312. The at least two left linking rods 33 (the present invention is illustrated by way of example, but not limited thereto) are laterally spaced apart from each other. The top of each left linking rod 33 is pivotally connected to the first left accommodating slot 311 through a corresponding one of the positioning pins 35. The bottom of each left linking rod 33 is pivotally connected to the second left accommodating slot 321 through a corresponding one of the positioning pins 35. The at least two right linking rods 34 (the present invention is illustrated by way of example, but not limited thereto) are laterally spaced apart from each other. The top of each right linking rod 34 is pivotally connected to the first right accommodating slot 312 through a corresponding one of the positioning pins 35. The bottom of each right linking rod 34 is pivotally connected to the second right accommodating slot 322 through a corresponding one of the positioning pins 35. The tops of the left linking rods 33 and the right linking rods 34 face up in the direction of the horizontal plate 14, and the bottoms of the left linking rods 33 and the right linking rods 34 face in a direction away from the horizontal plate 14, so that the left linking rods 33 and the right linking rods 34 are arranged obliquely.

Moreover, the third body 32 has a first block portion 323, a second block portion 324 and a third block portion 325 sequentially connected to each other. The first block portion 323 corresponds in position to the second body 31. The first block portion 323 is provided with the second left accommodating slot 321 and the second right accommodating slot 322. The second block portion 324 corresponds in position to the elastic assembly 2 (or the horizontal plate 14). A screw thread 212 formed at the bottom of each first screw 21 is screwed to the second block portion 324. The third block portion 325 is provided with at least two second positioning pins 326 and a second screw 327. The second positioning pins 326 are laterally spaced apart from each other and pass through the third block portion 325, the horizontal plate 14 and the plate body 11. The second screw 327 is inserted upward to pass through the third block portion 325 and is screwed to the third block portion 325 in an adjustable manner. Accordingly, the linking rod assembly is formed. The second body 31 continuously obtains the vertical upward thrust towards the groove 4 and the inward thrust toward the horizontal plate 14 by the elastic elements 22, the at least two left linking rods 33 and the at least two right linking rods 34 that are obliquely arranged.

The linking rod clamping mechanism 100 further includes a fine adjustment assembly 6. The fine adjustment assembly 6 includes a cam lever 61, a flange 62, and a rotating handle 63. The cam lever 61 passes through the left vertical plate 12 and the right vertical plate 13. The cam lever 61 is provided with a cam 611. The cam 611 is located above the second screw 327 and is in contact with the second screw 327. The flange 62 is connected to one end of the cam lever 61 and is exposed outside the first body 1. The rotating handle 63 is connected to a side of the flange 62 away from the cam lever 61 for controlling the rotating direction of the cam lever 61. The cam mechanism is formed by the fine adjustment assembly 6. The cam 611 of the cam lever 61 is located above the second screw 327 and is in contact with the second screw 327, and the second screw 327 passes upwards through the third block portion 325 and is screwed to the third block portion 325 in an adjustable manner, therefore, rotating the second screw 327 can bring the third body 32 and the second body 31 to move closer to or away from the groove 4. Moreover, the cam lever 61 can be rotated through the rotating handle 63, and the outer diameter difference of the cam 611 of the cam lever 61 can be used to change the distance between the cam 611 and the second screw 327, so that the third body 32 and the second body 31 are moved closer to or away from the groove 4.

As shown in FIG. 4 to FIG. 8, the coaxial connector 200 and the printed circuit board 300 are interposed in the linking rod clamping mechanism 100 of the present invention. Wherein, the coaxial connector 200 is wrapped with an insulating plastic sleeve 210 and is located in the passage 5. The axle 220 of the coaxial connector 200 is disposed in the groove 4. The printed circuit board 300 is sandwiched between the first body 1 and the second body 31 of the linking rod assembly 3. The second body 31 pushes the third body 32 upwards through the linkage of the left linking rods 33, the right linking rods 34 and the third body 32, so that the second body 31 obliquely clamps the printed circuit board 300 toward the horizontal plate 14 and toward the first body 1, and the printed circuit board 300 is electrically connected to the axle 220 of the coaxial connector 200.

Moreover, after the test is completed, the third body 32 can be moved downwards. Similarly, the left linking rods 33, the right linking rods 34, and the third body 32 are interlinked with each other, and the second body 31 is obliquely moved away from the horizontal plate 14 and away from the first body 1, so that the first body 1 and the second body 31 are separated from each other so as to disengage the coaxial connector 200 from the printed circuit board 300. In this way, the positioning is achieved in a push manner, which is a convenient operation to save the working hours. The printed circuit board 300 can be attached to the first body 1 and the second body 31 closely, and can be attached to the vertical surface of the horizontal plate 14. In addition, compared with the prior art that is secured and detached by means of screws, the present invention not only exerts an even force but also can determine the yield. There is no need to spend time for adjustment. Furthermore, the present invention does not require a welding procedure. Only the printed circuit board 300 needs to be clamped after the adjustment and the test can be performed, and it can be quickly replaced and reused, thereby improving the yield and increasing the error tolerance.

In addition, after the printed circuit board 300 is clamped by the first body 1 and the second body 31, if the alignment is inaccurate or the printed circuit board 300 needs to be adjusted before the test or during the test, the cam lever 61 can be rotated by the rotating handle 63 of the fine adjustment assembly 6, and the cam 611 of the cam lever 61 abuts against the second screw 327 (one end having a screw thread). The elasticity of the elastic assembly 2 enables the first body 1 and the second body 31 to have a slight space there between for the printed circuit board 300 to be finely adjusted. There is no need to re-position the entire linking rod clamping mechanism 100, which facilitates operation and saves working hours, thereby reducing the probability of a test error.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A linking rod clamping mechanism for connecting a coaxial connector with a printed circuit board, comprising:

a first body;

an elastic assembly, passing through the first body from top to bottom;

a linking rod assembly, a portion of the linking rod assembly being connected to a bottom of the elastic assembly and being movably connected to the first body;

a groove, disposed on a surface of the first body, facing the linking rod assembly; and a passage, disposed at a portion of the first body away from the linking rod assembly and communicating with the groove;

wherein the first body has a plate body, a left vertical plate, a right vertical plate and a horizontal plate, the left vertical plate and the right vertical plate are located at left and right sides of the plate body and extend downward from a lower surface of the plate body respectively, left and right sides of the horizontal plate are connected to the left vertical plate and the right vertical plate respectively, an upper surface of the horizontal plate is connected to the lower surface of the plate body, and the passage is disposed on the lower surface of the plate body.

2. The linking rod clamping mechanism as claimed in claim 1, wherein the first body has at least two stepped holes that are spaced and vertically pass through the plate body and the horizontal plate.

3. The linking rod clamping mechanism as claimed in claim 2, wherein the elastic assembly has at least two first screws and at least two elastic elements, the first screws pass through the corresponding stepped holes respectively, respective bottoms of the first screws are connected to the linking rod assembly, the elastic elements are sleeved on the corresponding first screws respectively, and two ends of each elastic element abut against a corresponding one of the stepped holes and a head of a corresponding one of the first screws, respectively.

4. The linking rod clamping mechanism as claimed in claim 3, wherein the linking rod assembly includes a second body, a third body, at least two left linking rods, at least two right linking rods and a plurality of first positioning pins, the second body is disposed close to the lower surface having the groove of the first body, the second body is formed with a first left accommodating slot and a first right accommodating slot close to left and right ends thereof, the third body is disposed under the second body, the third body has a second left accommodating slot and a second right accommodating slot, the second left accommodating slot corresponds in position to the first left accommodating slot, the second right accommodating slot corresponds in position to the first right accommodating slot, the at least two left linking rods are laterally spaced apart from each other, a top of each left linking rod is pivotally connected to the first left accommodating slot through a corresponding one of the positioning pins, a bottom of each left linking rod is pivotally connected to the second left accommodating slot through a corresponding one of the positioning pins, the at least two right linking rods are laterally spaced apart from each other, a top of each right linking rod is pivotally connected to the first right accommodating slot through a corresponding one of the positioning pins, a bottom of each right linking rod is pivotally connected to the second right accommodating slot through a corresponding one of the positioning pins, the tops of the left linking rods and the right linking rods are aligned with each other on a same horizontal line and face up in the direction of the horizontal plate, the bottoms of the left linking rods and the right linking rods are aligned with each other on another same horizontal line and face in a direction away from the horizontal plate, the left linking rods and the right linking rods are arranged obliquely relative to the second body and the third body.

5. The linking rod clamping mechanism as claimed in claim 4, wherein the third body has a first block portion, a second block portion and a third block portion sequentially connected to each other, the first block portion corresponds in position to the second body, the first block portion is provided with the second left accommodating slot and the second right accommodating slot, the second block portion corresponds in position to the elastic assembly, a screw thread formed at the bottom of each first screw is screwed to the second block portion, the third block portion is provided with at least two second positioning pins and a second screw, the second positioning pins are laterally spaced apart from each other and pass through the third block portion, the horizontal plate and the plate body, the second screw is inserted upward to pass through the third block portion and is screwed to the third block portion in an adjustable manner.

6. The linking rod clamping mechanism as claimed in claim 5, further comprising a fine adjustment assembly, the fine adjustment assembly including a cam lever, a flange and a rotating handle, the cam lever passes through the left vertical plate and the right vertical plate, the cam lever is provided with a cam, the cam is located above the second screw and is in contact with the second screw, the flange is connected to one end of the cam lever and is exposed outside the first body, the rotating handle is connected to one side of the flange away from the cam lever.

* * * * *